US010694302B2

(12) United States Patent
Hasani

(10) Patent No.: US 10,694,302 B2
(45) Date of Patent: Jun. 23, 2020

(54) HEARING AID

(71) Applicant: SIVANTOS PTE. LTD., Singapur (SG)

(72) Inventor: Hamed Hasani, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/183,879

(22) Filed: Nov. 8, 2018

(65) Prior Publication Data

US 2019/0141460 A1 May 9, 2019

(30) Foreign Application Priority Data

Nov. 8, 2017 (DE) ..... 10 2017 219 882

(51) Int. Cl.

| | |
|---|---|
| ***H04R 25/00*** | (2006.01) |
| ***H01Q 9/26*** | (2006.01) |
| ***H01Q 1/27*** | (2006.01) |
| *H01Q 1/40* | (2006.01) |

(52) U.S. Cl.

CPC ..... *H04R 25/554* (2013.01); *H01Q 1/273* (2013.01); *H01Q 9/26* (2013.01); *H04R 25/00* (2013.01); *H04R 25/65* (2013.01); *H01Q 1/40* (2013.01); *H04R 2225/025* (2013.01); *H04R 2225/51* (2013.01)

(58) Field of Classification Search

CPC ..... H04R 25/00; H04R 25/55; H04R 25/554; H04R 25/558; H04R 25/60; H04R 25/609; H04R 25/65

USPC ..... 381/312, 314, 322, 323, 326, 331

See application file for complete search history.

(56) References Cited

U.S. PATENT DOCUMENTS

| | | | | |
|---|---|---|---|---|
| 5,721,783 | A | 2/1998 | Anderson | |
| 6,144,749 | A * | 11/2000 | Fideler | H04R 25/602 381/312 |
| 10,187,734 | B2 | 1/2019 | Kvist et al. | |
| 2010/0020994 | A1 | 1/2010 | Christensen et al. | |
| 2016/0381470 | A1* | 12/2016 | Henriksen | H04R 25/554 381/315 |
| 2018/0084351 | A1* | 3/2018 | Polinske | H04R 25/554 |
| 2019/0191256 | A1* | 6/2019 | Kvist | H04R 25/554 |

FOREIGN PATENT DOCUMENTS

| | | | |
|---|---|---|---|
| DE | 69637454 | T2 | 3/2009 |
| DE | 102008022127 | A1 | 11/2009 |
| EP | 2986030 | A1 | 2/2016 |
| JP | H118894 | A | 1/1999 |
| JP | 2004508155 | A | 3/2004 |
| JP | 2016042691 | A | 3/2016 |

* cited by examiner

*Primary Examiner* — Walter F Briney, III

(74) *Attorney, Agent, or Firm* — Laurence A. Greenberg; Werner H. Stemer; Ralph E. Locher

(57) ABSTRACT

A hearing aid which is insertable into the ear of a hearing aid wearer includes a housing shell for receiving hearing aid components, a faceplate that closes off the housing shell, and a dipole antenna. The dipole antenna is embodied with a helical structure having at least one complete turn and a helix axis that is aligned parallel to the faceplate.

8 Claims, 3 Drawing Sheets

HEARING AID

CROSS-REFERENCE TO RELATED APPLICATION

This application claims the priority, under 35 U.S.C. § 119, of German Patent Application DE 10 2017 219 882.6, filed Nov. 8, 2017; the prior application is herewith incorporated by reference in its entirety.

BACKGROUND OF THE INVENTION

Field of the Invention

The invention relates to a hearing aid that is insertable into the ear of a hearing aid wearer.

A hearing aid serves to supply a hearing-impaired person with acoustic signals from the surroundings, which have been appropriately processed for compensating the respective hearing impairment and which, in particular, have been amplified. To that end, a hearing aid usually includes an input transducer, for example in the form of a microphone, a signal-processing unit with an amplifier, and an output transducer. The output transducer is generally realized as a miniaturized loudspeaker and is also referred to as receiver. It produces in particular acoustic output signals, which are forwarded to the ear of a patient and which produce the desired audio perception for that patient.

Different constructions of hearing aids are available for accommodating the numerous individual requirements. In the case of the so-called BTE (behind-the-ear) hearing aids, a housing with components such as a battery and the signal-processing unit is worn behind the ear. Depending on the configuration, the receiver can be worn directly in the auditory canal of the wearer (so-called receiver-in-canal (RIC) hearing aids). Alternatively, the receiver is disposed within the housing itself and a flexible sound tube, also referred to as a tube, guides the acoustic output signals of the receiver from the housing to the auditory canal (tube hearing aids). In the case of ITE (in-the-ear) hearing aids, a housing, which contains all functional components including the microphone and the receiver, is worn, at least in part, in the auditory canal. CIC (completely-in-canal) hearing aids are similar to ITE hearing aids, but are worn completely in the auditory canal.

The wireless communication of a hearing aid, for example with audio devices or (in the case of binaural care) with a second hearing aid inserted in the other ear of a hearing aid wearer, is often implemented by inductive signal transmission. In that case, (magnetic) coils with a multiplicity of turns are used as an antenna for transmitting and receiving the signals, with the geometric extent of the coils being substantially smaller than the wavelength of the transmitted or received signals. In the case of inductive signal transmission between hearing aids or a hearing aid and a different peripheral device, the frequency of the transmitted or received signals regularly lies in the range from approximately 10 kHz to approximately 50 MHz. The reach of such antennas is restricted to the near-field region of the transmitted or received signals.

Alternatively, electromagnetic signals in the GHz range, the wavelengths of which are approximately on the order of a hearing aid, are also used for the signal transmission between hearing aids or a hearing aid and another peripheral device. In that case, reference is made to radiofrequency (RF) signals or RF (signal) transmission. By way of example, the Bluetooth standard is a frequently employed standard for transmitting RF signals. RF signal transmission is regularly implemented over distances that correspond to a multiple of the wavelength of the transmitted or received signals, and consequently it uses the far field of those signals. Dipole antennas are often used to transmit and receive RF signals.

The length of a dipole antenna is advantageously chosen in such a way that it corresponds to half the wavelength or a small multiple thereof. Due to the very constricted installation space and due to the shielding of electromagnetic radiation by the surrounding body tissue of a hearing aid wearer, the integration of such an antenna in the housing of an in-the-ear hearing aid is problematic. Therefore, the transmission and reception efficiency of the antennas employed in such hearing aids is often less than required or desired.

In order to improve the efficiency of the antenna, German Publication DE 696 37 454 T2, corresponding to U.S. Pat. No. 5,721,783, and U.S. Publication No. 2010/0020994 A1 propose that the antenna be integrated in a pull-out string or a pull-out stick of a hearing aid, i.e. a string-like or stick-like article which projects to the outside from the faceplate of the hearing aid and that can be gripped by the fingers when the hearing aid is in the inserted state in order to pull the hearing aid out of the auditory canal. In that case, the part of the hearing aid disposed in outermost fashion in the worn state is advantageously used to keep the shielding influence of the body of the hearing aid wearer on the antenna as low as possible. However, a pull-out string or a pull-out stick extends largely parallel to the axis of the auditory canal.

Therefore, when viewed from the outside, the pull-out string or the pull-out stick has a virtually negligible extent. The emission that is directed to the outside from the opening of the auditory canal of such an antenna is correspondingly weak. By contrast, such an antenna emits the majority of the field intensity perpendicular to its longitudinal extent, where that field component is damped, once again, by the outer region of the auditory canal and the auricle.

SUMMARY OF THE INVENTION

It is accordingly an object of the invention to provide a hearing aid, which overcomes the hereinafore-mentioned disadvantages of the heretofore-known devices of this general type and which specifies an option for easily increasing the radiation efficiency of an antenna that is integrated into a hearing aid.

With the foregoing and other objects in view there is provided, in accordance with the invention, a hearing aid which is inserted into the ear of a hearing aid wearer and comprises a housing shell for receiving hearing aid components and a faceplate that closes off the housing shell. Usually, the faceplate has either a flat or a slightly curved configuration. The position of the faceplate consequently defines a (plane or slightly curved) surface. In this case, slightly curved means that the radius of curvature of the surface is substantially greater than the extent of the faceplate (in particular by at least a factor of 5 to 10).

Furthermore, the hearing aid includes a dipole antenna, which is embodied with a helical structure with at least one complete turn and a helix axis that is aligned parallel to the faceplate. In this case, a complete turn refers to a portion of the antenna that—as seen in a projection along the helix axis—forms a full circle (360°).

In a preferred configuration of the invention, the, or each, turn of the dipole antenna passes through an area occupied by a faceplate, and so at least one inner portion of the dipole antenna is guided on the inner side of this area and at least one outer portion of the dipole antenna is guided on the outer side of this area. It is further advantageous within the scope of the invention if the dipole antenna is integrated into the faceplate. In such a configuration, no portion of the dipole antenna protrudes from the material of the faceplate. A likewise preferred configuration of the invention provides for the faceplate to be disposed in a groove formed in the faceplate.

The use of a dipole antenna, which is embodied as described above and which is disposed at the faceplate, facilitates both a wireless communication between hearing aids and a wireless communication with external audio sources. The radiation characteristic of the dipole antenna is improved as a result of the configuration according to the invention of the dipole antenna at the faceplate. The radiation pattern of the dipole antenna has a maximum outside of the ear of the respective hearing aid wearer, and so radiation losses as a result of the ear are minimized and, as a result thereof, the efficiency of the dipole antenna is correspondingly improved. Expressed differently, the radiation efficiency of the dipole antenna is increased in the configuration according to the invention in relation to conventional antennas.

A helical structure within the meaning of the present invention is understood to mean a substantially helix-shaped structure with a number of turns. The helix-shaped structure has a helix axis that is aligned parallel to the faceplate. Preferably, the two poles of the dipole antenna are bent in opposite directions. Expressed differently, each pole of the dipole antennas is thus bent in the opposite direction in relation to the other pole.

In this case, the housing shell and the faceplate closing off the latter together form the housing of the hearing aid. Expediently, the faceplate is equipped with standard components such as microphones, battery contacts and the like. Further, the faceplate can be embodied with actuation elements such as setting dials or switches, which enable an operation of the hearing aid (for example by changing the hearing program).

Within the scope of the invention, a portion of the dipole antenna guided on the inner side of the area occupied by the faceplate is understood to mean the portion of the dipole antenna that is disposed within the housing or within the housing shell in the case of an assembled housing. Expressed differently, the at least one inner portion of the dipole antenna is guided on the inner side of the area occupied by the faceplate, in particular in relation to the housing. Analogous thereto, the portion of the dipole antenna guided on the outer side of the area occupied by the faceplate is understood within the scope of the invention to mean those portions that are disposed outside of the housing, i.e., on the side of the housing directed to the outside, in the case of an assembled housing. Expressed differently, the at least one outer portion of the dipole antenna is guided outside of the area occupied by the faceplate, in particular in relation to the housing.

Preferably, the dipole antenna has more than one complete turn and up to two turns. Thus, $1>N\geq 2$, where N can be any real number and preferably applies to the number of turns N. Particularly preferably, the dipole antenna has 1.5 turns.

In a preferred configuration, the, or every, outer portion of the dipole antenna protrudes from the material of the faceplate. This further improves the radiation efficiency or the emission characteristic of the dipole antenna.

In an alternatively preferred configuration of the invention, the faceplate has at least one protrusion that has an integral or one-piece construction with the faceplate on the outer side thereof, and the, or every, outer portion of the dipole antenna is embedded in the protrusion. To this end, it is preferable for the, or each, (partial) turn of the dipole antenna guided on the outer side of the faceplate to be insert molded.

Expediently, the dipole antenna is embodied as a metallic wire. Within the scope of the invention, the metallic wire may be flexible and hence adaptable to the geometry of the faceplate of the corresponding hearing aid. In an alternatively preferred fashion, a rigid wire is used as a dipole antenna. In an advantageous configuration, the metallic wire forming the dipole antenna is embodied with a round cross section. In an alternatively preferred configuration, the dipole antenna is embodied as a metallic flat wire.

Further preferably, the faceplate has an integral or one-piece construction with the housing shell. Thus, the faceplate is not a separate component in this case but, instead, it is a part of the housing shell. Expressed differently, the faceplate is manufactured in integral or one-piece fashion with the housing shell.

The hearing aid itself expediently includes at least one microphone, a signal-processing unit with an amplifier and a receiver, and further electronic and functional components. The respective components preferably are disposed within the housing shell and/or preferably are constituent parts of the housing. Preferably, the hearing aid is embodied as an ITE hearing aid. In an alternatively preferred fashion, the hearing aid is embodied as a CIC hearing aid.

Other features which are considered as characteristic for the invention are set forth in the appended claims.

Although the invention is illustrated and described herein as embodied in a hearing aid, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
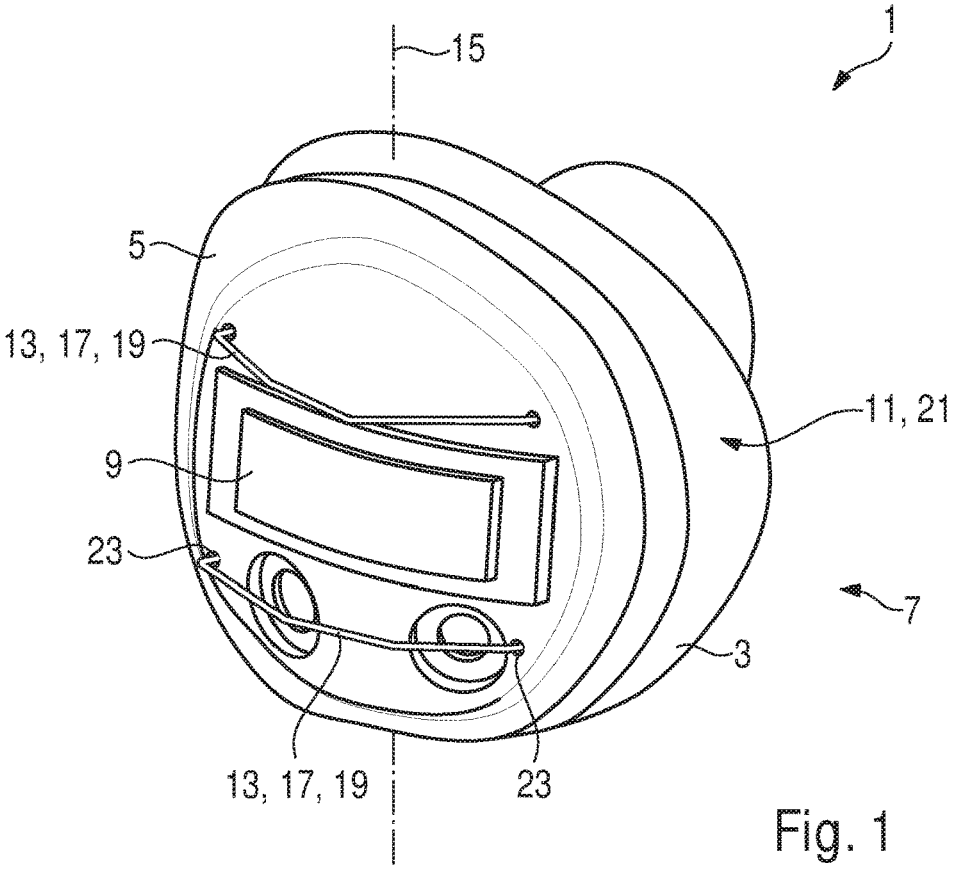
FIG. 1 is a diagrammatic, perspective view of a hearing aid having a dipole antenna with 1.5 turns that passes through a faceplate.

Referring now to the figures of the drawings in detail and first, particularly, to FIG. 1 thereof, there is seen a hearing aid 1, insertable into the ear of a hearing aid wearer, with a housing shell 3 and a faceplate 5 that closes off the housing shell 3. The housing shell 3 and the faceplate 5 together form a housing 7 of the hearing aid 1. A toggle switch 9, which is disposed in the faceplate 5, acts as an actuation element of electronic components disposed in an interior 11 of the housing 7. The electronic components cannot be seen due to the closed illustration of the hearing aid 1. This also applies to further hearing aid components disposed within the housing 7, such as one (or more) microphones, a signal-processing unit with an amplifier and a receiver, and further electronic and functional components.

A dipole antenna 13 made of a metallic wire is disposed at the faceplate 5. The dipole antenna 13 has a helical structure with a helix axis 15 that is aligned parallel to the faceplate 5 and with 1.5 turns 17 in the present case. The turns 17 of the dipole antenna 13 pass through an area F occupied by the faceplate 5 (which is plotted in FIGS. 4 and 5). Accordingly, two outer portions 19 of the dipole antenna 13 are guided on the outer side of this area F and hence outside of the housing 7 or outside of the housing shell 3. An inner portion 21 of the dipole antenna 13 is guided within the inner side of the area F, and hence within the housing 7 or outside of the housing shell 3 (in the interior 11). To this end, appropriate openings 23 have been introduced into the faceplate, through which the turns 17 of the dipole antenna 13 are guided. The outer portions 19 of the dipole antenna 13 are exposed and they protrude from the material of the faceplate 5.

Figure 2:
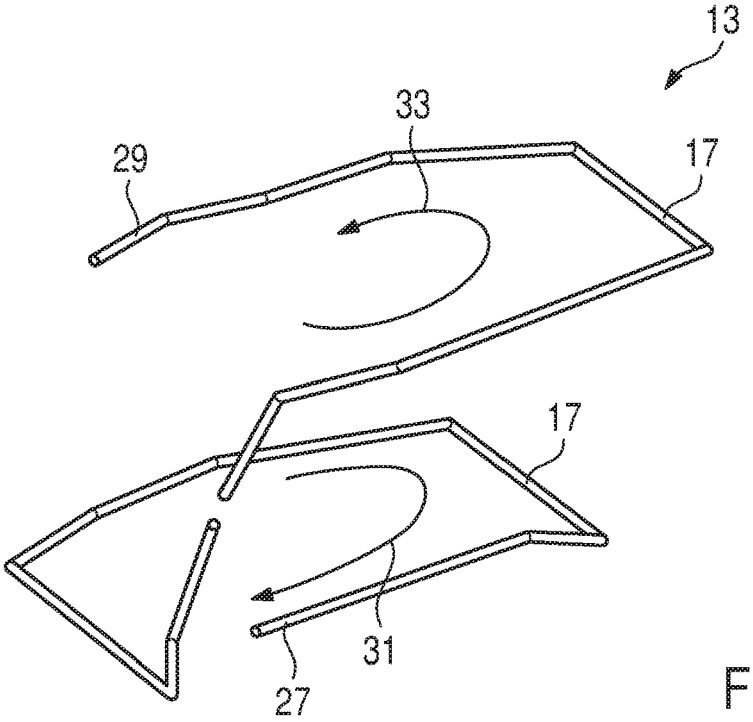
FIG. 2 is a perspective view of the dipole antenna according to FIG. 1 in a separate illustration.

The dipole antenna 13 according to FIG. 1 is shown separately in FIG. 2. The dipole antenna 13 has two poles 27, 29, which are bent in opposite directions in relation to the respective other pole 27, 29. In the present case, the lower pole 27 is bent clockwise 31 whereas the upper pole 29 is bent counterclockwise 33. As a result of a dipole antenna that is embodied in this way and disposed at the faceplate 5 of a hearing aid 1, the radiation characteristic of the dipole antenna 13 is improved over conventional antennas. Due to the exposed outer portions 19 of the dipole antenna 13, the radiation pattern of the dipole antenna 13 has a maximum outside of the ear of the respective hearing aid wearer in the inserted state, and so radiation losses by the ear are minimized and the efficiency of the dipole antenna is improved accordingly as a result thereof.

Figure 3:
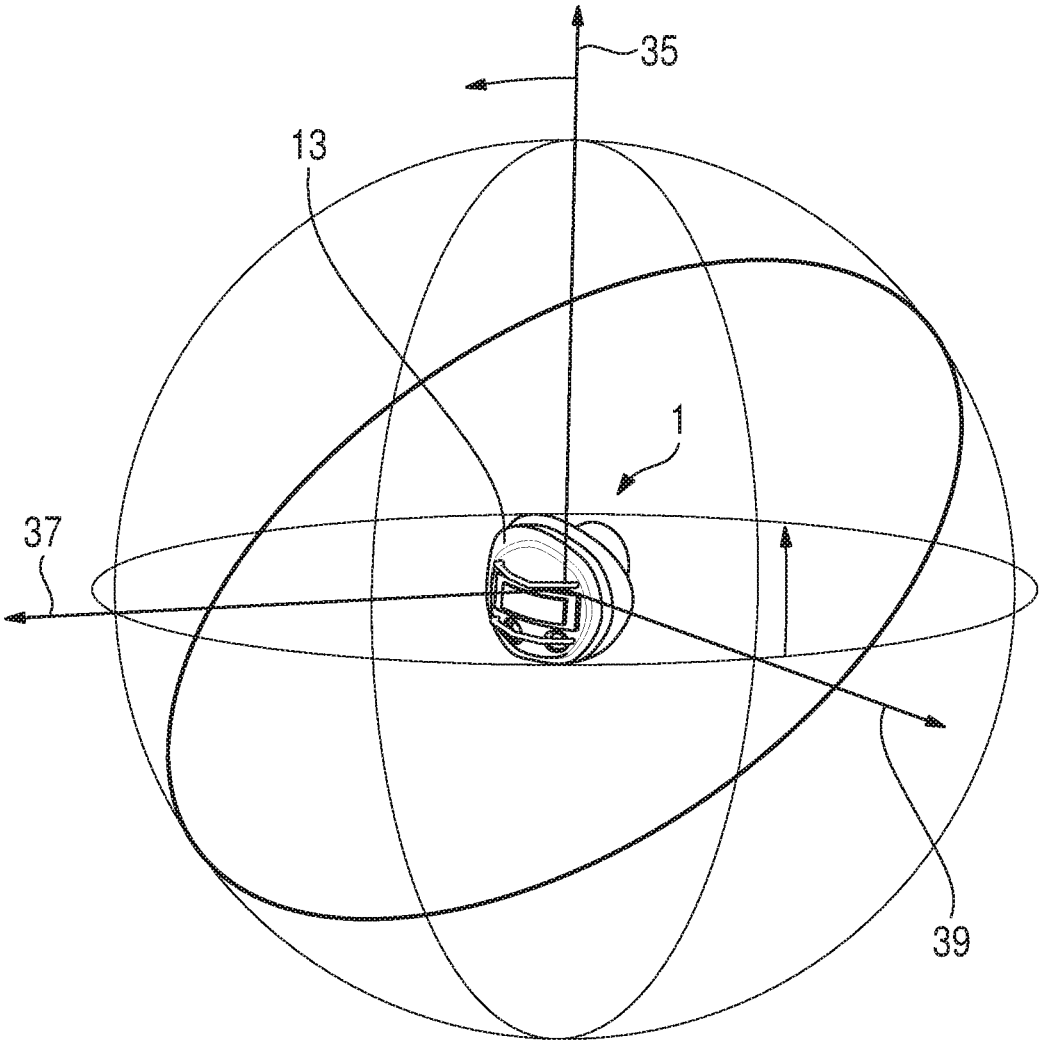
FIG. 3 is a perspective view of the hearing aid according to FIGS. 1 and 2, showing a radiation characteristic of the dipole antenna.

The radiation characteristic or the radiation pattern of the dipole antennas 13 used in the hearing aid 1 is shown in FIG. 3 on the basis of spatial directions 35 (x-direction), 37 (y-direction) and 39 (z-direction). In the present case, the maximum of the radiation extends in the y-direction 37, which extends away from the ear or the head of the hearing aid wearer in the case of an inserted hearing aid 1.

Figure 4:
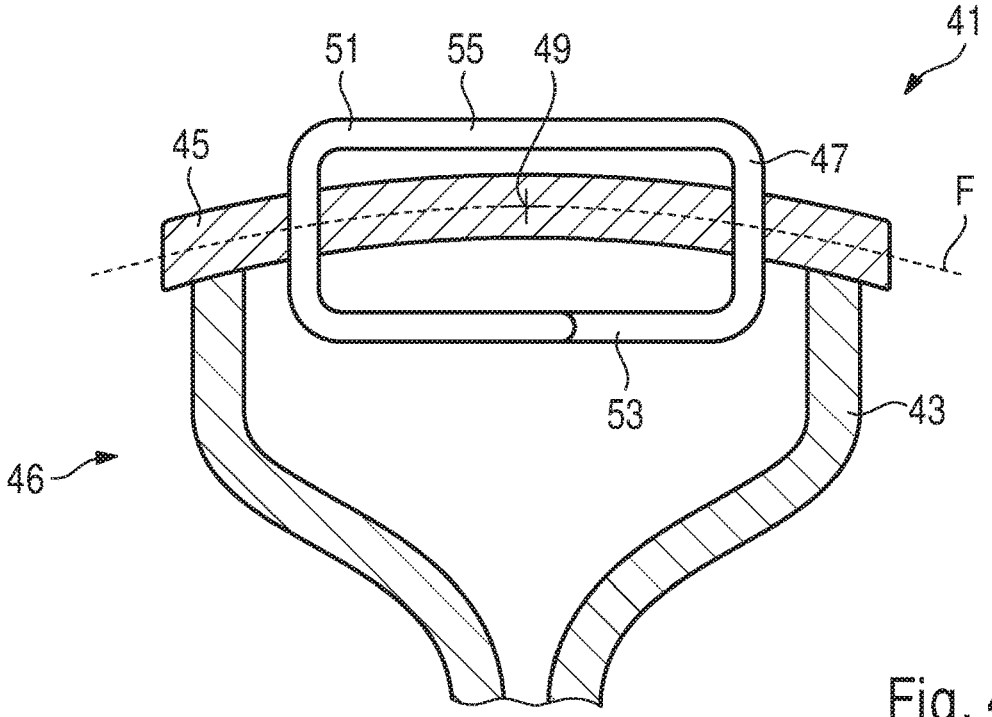
FIG. 4 is an off-centered, diagrammatic, longitudinal-sectional view of a hearing aid having a dipole antenna with one complete turn that passes through the faceplate.

FIG. 4 shows a highly-diagrammatic, off-centered, longitudinal section through a further hearing aid 41 that is insertable into the ear of a hearing aid wearer. The hearing aid 41 includes a housing shell 43 and a faceplate 45 that close off the housing shell 43. The housing shell 43 and the faceplate 45 together form a housing 46 of the hearing aid 41. In this case, too, a dipole antenna 47 made of a metallic wire is disposed at the faceplate 45. The dipole antenna 47 has a helical structure with a helix axis 49 that is aligned parallel to the faceplate 45 and with one turns 51 in the present case. The turn 51 passes through the area F which is occupied by the faceplate 45. In relation to the housing 46, an inner portion 53 of the dipole antenna 47 is guided on the inner side of the area F, while an outer portion 55 of the dipole antenna 47 is guided on the outer side of the area F in relation to the housing 46. According to FIG. 4, the portion 53 of the dipole antenna 47 is exposed and it protrudes from the material of the faceplate 5.

Figure 5:
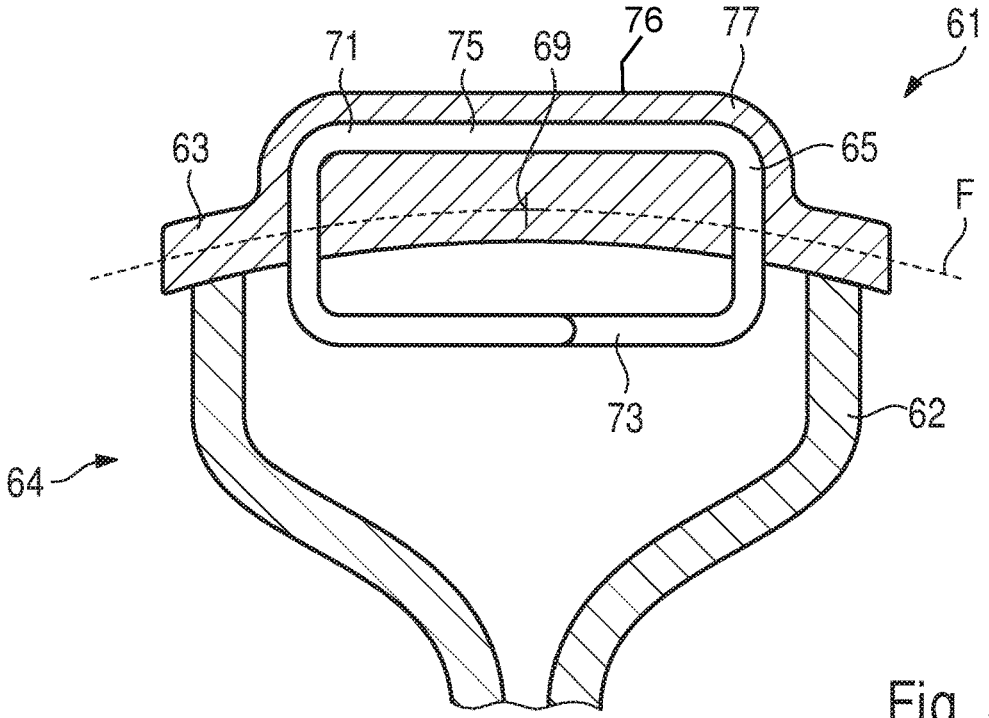
FIG. 5 is an off-centered, diagrammatic, longitudinal-sectional view of a further hearing aid having a dipole antenna with one complete turn that passes through the faceplate.

FIG. 5 shows a highly-diagrammatic, off-centered longitudinal section of a further hearing aid 61 that is insertable into the ear of a hearing aid wearer. The hearing aid 61 likewise includes a housing shell 62 and a faceplate 63 that closes off the housing shell 62. The housing shell 62 and the faceplate 63 form a housing 64 of the hearing aid 61. As in FIG. 4, a dipole antenna 65 made of a metallic wire is also disposed at the faceplate 63 of the hearing aid 61. The dipole antenna 65 has a helical structure with a helix axis 69 that is aligned parallel to the faceplate 63 and likewise with one turn 71, which passes through an area F occupied by the faceplate 63. In this case, too, an inner portion 73 of the dipole antenna 65 is guided on the inner side of the area F in relation to the housing 64. An outer portion 75 is guided on the outer side of the area F, in relation to the housing 64.

In contrast to the hearing aid 41 according to FIG. 4, the faceplate 63 is embodied with a protrusion 77 at its outer side 76 in the present case. The protrusion 77 is formed integrally or in one piece with the faceplate 63 and is molded around the outer portion 73. Consequently, the portion 75 of the dipole antenna 63 is not exposed in the present case but instead is embedded in the protrusion 77.

The invention becomes particularly clear on the basis of the exemplary embodiments described above. Nevertheless, it is not restricted to these exemplary embodiments. Rather, further embodiments of the invention can be derived from the claims and the description above.

The following is a summary list of reference numerals and the corresponding structure used in the above description of the invention.

LIST OF REFERENCE SIGNS

1 Hearing aid
3 Housing shell
5 Faceplate
7 Housing
9 Switch
11 Interior
13 Dipole antenna
15 Helix axis
17 Turn
19 Inner portion
21 Outer portion
23 Opening
27 Pole of the dipole antenna
29 Pole of the dipole antenna
31 Clockwise direction
33 Counterclockwise direction
35 x-direction
37 y-direction
39 z-direction
41 Hearing aid
43 Housing shell
45 Faceplate
46 Housing
47 Dipole antenna
49 Helix axis
51 Turn
53 Inner portion
55 Outer portion
61 Hearing aid
62 Housing shell

63 Faceplate
64 Housing
65 Dipole antenna
69 Helix axis
71 Turn
73 Inner portion
75 Outer portion
76 Outer side
77 Protrusion

The invention claimed is:

1. A hearing aid insertable into the ear of a hearing aid wearer, the hearing aid comprising:

a housing shell for receiving hearing aid components;

a faceplate closing off said housing shell; and a dipole antenna having a helical structure with at least one complete turn and a helix axis aligned parallel to said faceplate;

said dipole antenna having two separate poles being bent in opposite directions relative to each other.

2. The hearing aid according to claim 1, wherein said dipole antenna has more than one complete turn and at most two turns.

3. The hearing aid according to claim 1, wherein:

said faceplate is formed of a material;

said dipole antenna has one outer portion or a plurality of outer portions; and said one outer portion or said plurality of outer portions protrude from said material of said faceplate.

4. The hearing aid according to claim 1, wherein:

said dipole antenna has one outer portion or a plurality of outer portions;

said faceplate has an outer side and at least one protrusion being integral with said outer side of said faceplate; and said one outer portion or said plurality of outer portions of said dipole antenna are embedded in said at least one protrusion.

5. The hearing aid according to claim 4, wherein said at least one protrusion is formed in one piece with said outer side of said faceplate.

6. The hearing aid according to claim 1, wherein said dipole antenna is a metallic wire.

7. The hearing aid according to claim 1, wherein said faceplate is integral with said housing shell.

8. The hearing aid according to claim 1, wherein said faceplate is formed in one piece with said housing shell.

* * * * *